United States Patent [19]

Hock et al.

[11] Patent Number: 4,785,777

[45] Date of Patent: Nov. 22, 1988

[54] ELECTRICAL CONTROL DEVICES FOR REGULATING AN INTERNAL COMBUSTION ENGINE

[75] Inventors: Gerhard Hock; Hilmar Strenzke, both of Aschaffenburg, Fed. Rep. of Germany

[73] Assignee: Linde Aktiengesellschaft, Wiesbaden, Fed. Rep. of Germany

[21] Appl. No.: 100,255

[22] Filed: Sep. 23, 1987

Related U.S. Application Data

[63] Continuation of Ser. No. 822,004, Jan. 24, 1986, abandoned.

[30] Foreign Application Priority Data

Jan. 24, 1985 [DE] Fed. Rep. of Germany ..... 3502255

[51] Int. Cl.[4] ..... F02D 41/14

[52] U.S. Cl. ..... 123/352; 123/361

[58] Field of Search ..... 123/361, 352, 357; 180/178, 179

[56] References Cited

U.S. PATENT DOCUMENTS

| | | | |
|---|---|---|---|
| 4,036,193 | 7/1977 | Kobayashi et al. | 123/139 |
| 4,188,926 | 2/1980 | Fleischer | 123/352 |
| 4,313,515 | 2/1982 | Mann | 123/361 |
| 4,389,990 | 6/1983 | Murray | 123/361 |
| 4,416,232 | 11/1983 | Schiozaki | 123/361 |

FOREIGN PATENT DOCUMENTS

| | | | |
|---|---|---|---|
| 2231859 | 12/1978 | France . | |
| 2544798 | 10/1984 | France . | |
| 767716 | 9/1980 | U.S.S.R. | 123/357 |
| 759737 | 9/1980 | U.S.S.R. | 123/357 |
| 1524632 | 9/1978 | United Kingdom . | |
| 1541267 | 2/1979 | United Kingdom . | |
| 2102600 | 2/1983 | United Kingdom . | |

*Primary Examiner*—Andrew M. Dolinar
*Attorney, Agent, or Firm*—Thomas R. Shaffer

[57] ABSTRACT

An electric control device for regulating the r.p.m. of a piston internal combustion engine is disclosed. The device has an integral r.p.m. regulator with an output connected to a final control element regulator electrically connected to an electromagnet that actuates an adjusting element of the engine. A nominal value signal and a signal from a tachometer are fed to the r.p.m. regulator. A current regulator is electrically connected between the r.p.m. regulator and the final control element regulator. The current regulator is acted upon by both a signal from the electromagnet and the r.p.m. regulating means by a summing element to control the final control regulator which acts on the electromagnet.

1 Claim, 1 Drawing Sheet

ELECTRICAL CONTROL DEVICES FOR REGULATING AN INTERNAL COMBUSTION ENGINE

This application is a continuation of application Ser. No. 822,044, filed Jan. 24, 1986, now abandoned.

This invention relates to electrical control devices for regulating an internal combustion engine and more particularly to electrical control devices for regulating the r.p.m. of an internal combustion engine having an r.p.m. regulating device for regulating the fuel mixture such as a carburetor in which the fuel mixture is regulated by a butterfly valve or some analagous device for adjusting the fuel mixture going to the engine.

Internal combustion engines having a carburetor or other means for adjusting the fuel mixture to the engine and thereby controlling the r.p.m. of the engine are common and well known.

One disadvantage of such devices indicated resides in the fact that with a variation in the parameters of the controlled system, e.g., a change in the engine behavior with the temperature or the outside air pressure, a change in the magnetic force with the temperature with identical supply voltage, a change in the mechanical friction at the butterfly valve or other mechanical components of the control device or a change in the spring pretension of the return spring of the magnet stability problems in regulation can arise.

The invention proposes to improve an r.p.m. regulator or speed regulating device according to the introductory part so that the stability of the regulating circuit is improved when a disturbance of the said type occurs in the regulated state of the speed regulating device.

This problem is solved by the provision of a current regulator electrically connected between the speed regulating means and the final control element regulator. The summation device delivers to the current regulator a signal representing the magnitude of current flowing through the electromagnet. The summation element also delivers the output signal of the speed regulating means to the current regulator whereby the current regulator is acted upon by both the signal from the electromagnet and the speed regulating means to control the final control element which acts upon the electromagnet. The control of a mixture metering device in this manner provides an integral regulator having improved stability. The time constant of the electromagnet is reduced by the current feedback obtained according to the invention. There is thus a substantial improvement in the dynamics and stability of the control loop. It should be noted here that the stabilization of a low-pass time constant is known in itself, but its use in an electric speed-regulating device with a magnet as the final control element is new. The stability problems that arise with a variation in the parameters of the control system, especially because the regulator should have an integral constituent, are substantially reduced by the arrangement according to the invention.

In the foregoing general description, we have set out certain objects and advantages of this invention. Other objects and advantages of this invention will be apparent from a consideration of the following description and the accompanying drawings in which.

Figure 1:
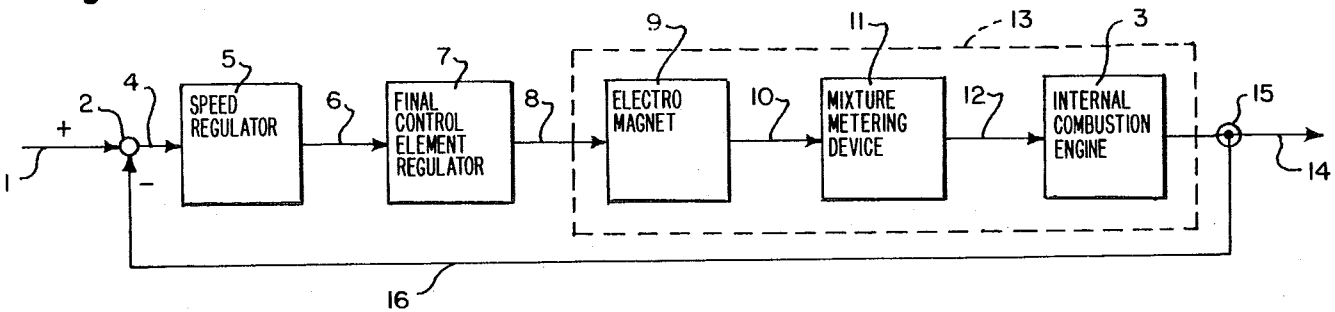
Fig. 1. PRIOR ART
FIG. 1 shows a representation of the prior state of the art in a symbol circuit diagram.

A nominal-value signal for the r.p.m. of the internal combustion engine symbolized by 3 in the drawing flows out from a nominal-value setter (not shown) through a line 1. This signal flowing through line 1 goes to a summation element 2, from which a signal is fed through the line 4 to the speed regulator 5, from which a signal flows through a line 6 to the final control element regulator 7, which is connected through a line 8 with the electromagnet 9 that constitutes the final control element, which is connected through a mechanical connection 10 with the mixture-metering device 11, from which the mixture flows through a tubular line 12 to the internal combustion engine, to the shaft 14 of which mechanical power is imparted. The components 9–12 and 3 constitute a control system that is symbolized by the field 13. The speed of the shaft 14 of the internal combustion engine 3 is measured in a tachometer device 15, from which a signal is fed through a line 16 to the summation element 2.

Figure 2:
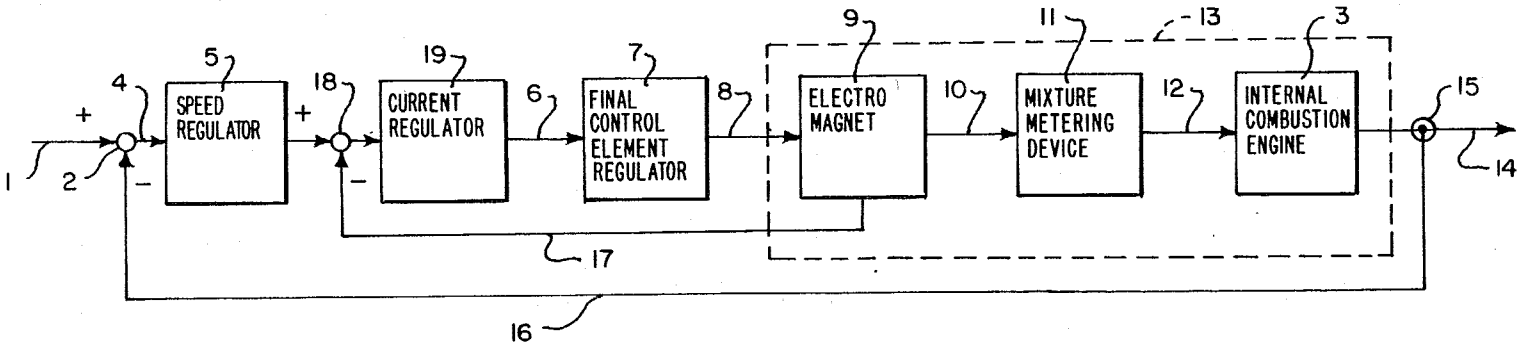
FIG. 2 shows a similar symbol circuit diagram for the circuit according to the invention.

The same components are also present in the arrangement shown in FIG. 2 according to the invention. However, an arrangement is also shown here, by which the current flowing through the electromagnet 9 is measured and the measurement value signal is fed through the line 17 to a summation element 18, which is located between the speed regulator 5 and an additionally provided current regulator 19, in which case this current regulator 19 is in turn located between the speed regulator 5 or the summation, element 18 on the one hand and the final control element regulator; on the other hand.

The drawing shows both the structure of the speed regulating circuit known to date with a low-pass control system, whose essential lag elements constitute the electromagnet and the internal combustion engine, and the structure of the speed regulating circuit according to the invention, in which the essential change consists in an additional current regulator and a current feedback that is superimposed on the current regulator.

In the forgoing specification we have set out certain preferred practices and embodiments of this invention, however, embodied within the scope of the following claims.

We claim:

1. In an electric control device regulating the r.p.m. of a piston internal combustion engine, having integral r.p.m. regulating means for metering of the fuel mixture, said regulating means having an output electrically connected to a final control element regulator, said final control element regulator electrically connected to an electromagnet that actuates an adjusting element connected to the internal combustion engine, said internal combustion engine provided with a tachometer whose signal is fed, together with a nominal-value signal, to the r.p.m. regulating means, the improvement comprising a current regulator electrically connected between the r.p.m. regulating means and the final control element regulator, summation means delivering to the current regulator a signal representing the magnitude of the current flowing through the electromagnet, said summation means also delivering the output signal of the r.p.m. regulating means to the current regulator whereby the current regulator is acted upon by both the signal from the electromagnet and the r.p.m. regulating means to control the final control regulator which acts on the electromagnet.

* * * * *

UNITED STATES PATENT AND TRADEMARK OFFICE

CERTIFICATE OF CORRECTION

PATENT NO. : 4,785,777

DATED : November 22, 1988

INVENTOR(S) : Gerhard Hock and Hilmar Strenzke

It is certified that error appears in the above-identified patent and that said Letters Patent is hereby corrected as shown below:

Column 1, line 7, change "822,044" to --822,004--.

Column 2, line 43, after "however," insert --it will be understood that this invention may be otherwise--.

Signed and Sealed this

Twenty-fifth Day of April, 1989

*Attest:*

DONALD J. QUIGG

*Attesting Officer*

*Commissioner of Patents and Trademarks*